US007641788B2

(12) United States Patent
Hansen et al.

(10) Patent No.: US 7,641,788 B2
(45) **Date of Patent: *Jan. 5, 2010**

(54) HYDROCARBON CONVERSION PROCESS AND CATALYST

(75) Inventors: Jens A. Hansen, Holte (DK); Niels Jørgen Blom, Hillerød (DK); Birgitte R. Byberg, Birkerød (DK); John W. Ward, Yorba Linda, CA (US)

(73) Assignee: Haldor Topsoe A/S, Lyngby (DK)

( * ) Notice: Subject to any disclaimer, the term of this patent is extended or adjusted under 35 U.S.C. 154(b) by 79 days.

This patent is subject to a terminal disclaimer.

(21) Appl. No.: 10/562,571

(22) PCT Filed: Jun. 14, 2004

(86) PCT No.: PCT/EP2004/006376

§ 371 (c)(1),
(2), (4) Date: Dec. 27, 2005

(87) PCT Pub. No.: WO2005/001000

PCT Pub. Date: Jan. 6, 2005

(65) Prior Publication Data

US 2006/0175231 A1 Aug. 10, 2006

(30) Foreign Application Priority Data

Jun. 26, 2003 (DK) ..... 2003 00960

(51) Int. Cl.
*C10G 11/04* (2006.01)

(52) U.S. Cl. ..... 208/120.01; 208/107; 208/108; 208/111; 502/67

(58) Field of Classification Search ..... 208/108, 208/111, 120.01, 107; 502/67
See application file for complete search history.

(56) References Cited

U.S. PATENT DOCUMENTS

| | | | | |
|---|---|---|---|---|
| 5,350,501 | A | 9/1994 | Ward | |
| 5,536,687 | A * | 7/1996 | Ward | 502/67 |
| 2002/0094931 | A1 | 7/2002 | Wang et al. | |

FOREIGN PATENT DOCUMENTS

| | | |
|---|---|---|
| WO | WO 97/20016 | 6/1997 |

* cited by examiner

*Primary Examiner*—Glenn Caldarola
*Assistant Examiner*—Prem C. Singh
(74) *Attorney, Agent, or Firm*—Dickstein Shapiro LLP

(57) ABSTRACT

A process for hydrocracking a hydrocarbonaceous feedstock into a middle distillate utilising a hydrocarbon conversion catalyst comprising a modified beta zeolite and a modified Y zeolite, an amorphous inorganic oxide and a hydrogenation component, wherein the said middle distillate is characterised by having a low aromatics content and/or a low pour point.

7 Claims, No Drawings

HYDROCARBON CONVERSION PROCESS AND CATALYST

TECHNICAL FIELD

This invention relates to the refining of petroleum hydrocarbons into products of greater utility and higher value as compared with the feedstock.

Conversion of hydrocarbons into useful products has been practised for many years using catalytic materials. In recent years, the use of catalysts containing zeolite materials has been found in many cases to be superior to the catalysts containing amorphous inorganic oxide materials such as alumina, silica-alumina and the like. Many zeolitic materials have been found to be useful as catalysts, but depending on the specific process, zeolites such as Y, X, omega, ZSM-5, beta and L have been found to be particularly advantageous.

This invention relates in general to catalytic compositions useful for hydrocarbon conversion and in particular to their use in hydrocarbon cracking reactions such as catalytic cracking and hydrocracking. More particularly, the invention relates to compositions comprising certain zeolites in combination and metal hydrogenation components and their use in hydrocracking processes. In particular, the invention relates to catalytic compositions comprising beta and Y zeolite in conjunction with a hydrogenation component and their use in hydrocracking of hydrocarbons. The invention relates moreover to the composition and use of catalytic compositions comprising specifically modified beta zeolites and modified Y zeolites, which give enhanced performance in hydrocarbon conversion reactions especially in the conversion of hydrocarbon feedstock to middle distillates.

Petroleum refiners frequently produce desirable products, such as gasoline and middle distillates by catalytically hydrocracking high boiling hydrocarbons into product hydrocarbons of lower average molecular weight and boiling point. Hydrocracking is generally accomplished by contacting, in an appropriate reactor vessel, a gas oil or other hydrocarbon feedstock with a suitable hydrocracking catalyst under appropriate conditions including an elevated temperature and an elevated pressure and the presence of hydrogen, such that a hydrocarbon product is obtained containing a substantial portion of a desired product boiling in a specified range, as for example, a gasoline boiling in the range of 85° C. to 215° C. or middle distillate boiling in the range of 150° C. to 425° C.

Usually, hydrocracking is practised in a single reaction vessel or several in series utilising a single catalyst. In such a scenario, the catalyst not only hydrocracks the hydrocarbon feedstock, but simultaneously or sequentially converts the organonitrogen and organosulphur containing compounds into ammonia and hydrogen sulphide. Some isomerisation of normal or near normal paraffins can also take place simultaneously.

Hydrocracking can also be performed in conjunction with hydrotreating usually by a method referred to as "integral operation". In this process, the hydrocarbon feedstock usually a gas oil containing a substantial proportion of components boiling above a desired end point, as for example 215° C. in the case of certain gasolines, is introduced into a catalytic hydrotreating zone wherein, in the presence of a suitable catalyst, such as a zeolite or sieve-free, particulate catalyst comprising a Group VIII metal component and a Group VIB metal component on a porous, inorganic, refractory oxide catalyst support most often composed of alumina and under suitable conditions including an elevated temperature (e.g. 250° C. to 540° C.) and an elevated pressure (e.g. 0.7 to 35 MPa) and with hydrogen as a reactant, the organonitrogen components and the organosulphur components contained in the feedstock are converted to ammonia and hydrogen sulphide, respectively. Subsequently, the entire effluent removed from the hydrotreating zone is treated in a hydrocracking zone maintained under suitable conditions of elevated temperature, pressure and hydrogen partial pressure and containing a suitable hydrocracking catalyst such that a substantial conversion of high boiling feed components to products components boiling below the desired end point is obtained. Usually, the hydrotreating and hydrocracking zones in integral operation are maintained in separate reactor vessels, but on occasion it may be advantageous to employ a single, downflow reactor vessel containing an upper bed of hydrotreating catalyst particles and lower bed of hydrocracking particles. Examples of integral operation may be found in U.S. Pat. Nos. 3,132,087; 3,159,564; 3,655,551; and 4,040,944, all of which are herein incorporated by reference in their entireties.

When two catalysts in two separate vessels are used, it is often desirable to fractionate (or separate) the products of the first reactor (hydrotreating) so as to remove the produced ammonia, hydrogen sulphide and light gaseous hydrocarbons from the feed to the hydrocracking reactor. Such separation can also be made when two similar catalysts are used.

In some integral operation refining processes, and especially those designed to produce gasoline from the heavier gas oils, a relatively high proportion of the product hydrocarbons obtained from integral operation will have a boiling point above the desired end point. For example, in the production of a gasoline product boiling in the $C_4$ to 215° C. range from a gas oil boiling entirely above 300° C., it may often be the case that as much as 30 to 60 percent by volume of the products obtained from integral operation boil above 215° C. To convert these high boiling components to hydrocarbon components boiling below 215° C., the petroleum refiner separates the 215° C.+ high boiling components from the other products obtained in integral operation, usually after first removing ammonia by a water washing operation, a hydrogen-containing recycle gas by high pressure separation and an $H_2S$-containing, $C_1$ to $C_3$ low BTU gas by low pressure separation. This 215° C.+ boiling bottom fraction is then subjected to further hydrocracking either by recycle to the hydrocracking reactor in single stage operation or by introduction into a second hydrocracking zone wherein yet more conversion to the desired $C_4$ to 215° C. product takes place.

In the foregoing two-stage process, the two hydrocracking reaction zones often contain hydrocracking catalysts of the same composition. One catalyst suitable for such use is disclosed as Catalyst A in Example 16 of U.S. Pat. Nos. 3,897,327 and 3,929,672, both of which are herein incorporated by reference in their entireties, which catalyst is comprised of a palladium-exchanged, steam-stabilised Y zeolite hydrocracking component. But although the catalysts used in the two hydrocracking reaction zones may have the same composition and the same catalytic properties, the hydrocracking conditions required in the second hydrocracking reaction zone are less severe than those required in the first. The reason for this is that ammonia is not present in the second hydrocracking reaction zone (due to water washing), whereas a significant amount of ammonia is present in the first hydrocracking zone. To account for the difference in operating conditions, it is believed that ammonia neutralises or otherwise interferes with the acidity of the zeolite in the catalyst of the first reaction zone, thereby forcing the refiner to employ relatively severe conditions for operation, as for example increased temperature. On the other hand, in the ammonia-deficient atmosphere of the second hydrocracking reaction zone, high conversions to the desired product are obtainable under relatively moderate conditions, often with an operating temperature about 50° C. to 110° C. lower than that required in the first hydrocracking reaction zone.

Further description of two-stage hydrocracking operations may be found in U.S. Pat. Nos. 4,429,053 and 4,857,169 herein incorporated by reference in their entireties, which patents provide process flow sheets for typical two-stage hydrocracking processes.

Although there exist several types of commercial hydrocracking catalysts which can be used effectively in single stage hydrocracking or either the first, second or both stages of the above-discussed two-stage hydrocracking process, there is always a demand for new catalysts with superior overall activity, selectivity and stability for producing gasoline and/or middle distillate via hydrocracking.

WO patent application No. 92/16293 discloses a hydrocracking process for the production of particularly gasoline and jet fuel. A catalyst comprising zeolite Beta and Y xeolite having a unit cell size above about 24.40 Å and preferably 15 wt % of each zeolite is used in combination with one or more hydrogenation components. This catalyst, however, is not suitable for use in the preparation of middle distillates with low aromatic content and it would be expected to lead to a product of low quality.

The general object of the present invention is directed to novel catalysts and catalyst supports and novel acid catalysed chemical conversion processes employing such catalysts to promote the desired reactions. The present invention is particularly directed to hydrocarbon conversion catalysts and hydrocarbon conversion processes employing such catalysts comprising a hydrogenation component(s) on a catalyst support comprising modified zeolite beta and modified zeolite Y.

SUMMARY OF THE INVENTION

The present invention provides a composition for use in the acid catalysed chemical conversion of a feedstock containing organic compounds into reaction products, particularly in the acid catalysed conversion of hydrocarbons and most especially in hydrocracking. The composition, which may be a catalyst and/or catalyst support, comprises a modified zeolite beta and a modified zeolite Y. One or more amorphous, inorganic refractory oxides such as alumina, silica-alumina or other inorganic oxides may also be present in the composition. For hydrocracking purposes, the catalyst requires a hydrogenation component such as one or more Group VIB and/or Group VIII metal components, the hydrogenation components generally being dispersed on the catalyst support material composed of the modified zeolite beta, modified zeolite Y and amorphous oxides.

The catalysts are characterised specifically by having a catalyst support comprising a modified beta zeolite and a modified Y zeolite, the Y zeolite having a unit cell size below 24.40 Å and both possessing activity for promoting cracking reactions.

The catalysts have been found to be more active and more efficient to produce lower aromatics in the middle distillate products than those of the prior art. The middle distillate products of using such catalysts are also of low pour points.

DETAILED DESCRIPTION OF THE INVENTION

The present invention is directed to novel catalysts and/or catalyst supports and novel acid catalysed chemical conversion processes employing such catalysts to promote the desired reactions.

The present invention is particularly directed to hydrocracking catalysts and hydrocracking processes employing such catalysts comprising a hydrogenation component on a support comprising a beta zeolite and a Y zeolite, the Y zeolite having a unit cell size below 24.40 Å.

The hydrocracking catalysts of the invention unexpectedly produce a lower aromatics product than a catalyst comprising a calculated average of the two components. Preferred forms of the zeolite are those which have been ion exchanged to remove alkali ions to a low level and have more preferably been hydrothermally treated and still more preferably acid washed or otherwise been treated so as to increase the silica to alumina ratio.

The catalysts of the invention have been shown to be more active and at the same time produce lower aromatics in the middle distillate product than the prior art. The products of using such catalysts are also of low pour point.

Zeolite beta is a crystalline zeolite whose composition and X-ray powder diffraction analysis are disclosed in U.S. Pat. Reissue No. 28,341, herein incorporated by reference in its entirety. This zeolite beta is a large pore zeolite having a molar silica to alumina ratio of 25-30 and a Constraint Index below 2, preferably between 0.6 and 1.0. Preparation of zeolite beta has been disclosed in U.S. Pat. Reissue No. 28,341. Standard preparation of zeolite beta having a $SiO_2$:$Al_2O_3$ molar ratio of 25-30 has been described in the $2^{nd}$ revised edition of "Verified Syntheses of Zeolitic Materials" by H. Robson (Editor) and K. P. Lillerud (XRD Patterns), Elsevier 2001, which is herein incorporated by reference in its entirety. Zeolite beta can be obtained commercially from companies like Tosoh Corporation, Japan; Zeolyst International, The Netherlands; or Süd-Chemie AG, Germany.

As initially prepared, zeolite beta is usually in the alkali metal form and contains an organic templating agent. In this form, the zeolite has low if any catalytic activity for promoting acid catalysed conversion reactions, e.g. cracking reactions. Accordingly, the zeolite is generally converted to more active forms by calcination to decompose and drive off the templating agent followed by base exchange with ammonium cations to substantially reduce the alkali metal content finally followed by another calcination to convert the ammonium-exchanged zeolite to the hydrogen form. For zeolite beta initially prepared in the sodium form, the preferred sodium content upon conversion to an active form is below 1.0 percent by anhydrous weight, preferably below about 0.5 percent by anhydrous weight, calculated as $Na_2O$.

Publications which further discuss the properties of zeolite Beta include U.S. Pat. Nos. 3,308,069; 3,923,641; 4,676,887; 4,812,223; 4,486,296; 4,601,993 and 4,612,108, all of which are herein incorporated by reference in their entireties. The beta zeolites have a silica-alumina ratio of at least 25, more preferably at least 100 and most preferably at least 250.

As mentioned previously, another component of the catalyst mixture of this invention is a zeolite such as zeolite Y, ultrastable zeolite Y or other natural or synthetic faujasite. As initially prepared, zeolite Y is usually in the alkali metal form with a molar silica to alumina ratio of about 5.

The Y zeolites used in the instant invention usually have the original cations associated therewith replaced by a wide variety of other cations according to techniques well known in the art. Typical replacing cations would include hydrogen, ammonium and metal cations including mixtures of the same. Of the replacing cations, particular preference is given to cations of ammonium and hydrogen.

Typical ion exchange techniques would be to contact the particular zeolite with a solution of a salt of the desired replacing cation or cations. Although a wide variety of salts can be employed, particular preference is given to chlorides, nitrates and sulphates.

A zeolite, which may be used, is the ultrastable zeolite Y. The ultrastable zeolites disclosed herein are well known to those skilled in the art. For example, they are described at pages 507-522 and pages 527 and 528 of the book Zeolite Molecular Sieves by Donald W. Breck, John Wiley & Sons, Inc. 1974 and are exemplified in U.S. Pat. Nos. 3,293,192 and 3,449,070. These two patents and the Breck reference above are incorporated herein by reference. These low soda, ultra stable zeolites are available commercially from the W.R. Grace & Company, Zeolyst Inc., Tosoh Inc. among others. Many other zeolites obtained by modifying the hydrothermal treatment and ion exchange of Y zeolites are now available. Such materials are envisioned as potential components of the catalyst.

It may be desirable to incorporate the zeolites into a material resistant to the temperatures and other conditions employed in the process. Such matrix materials include synthetic and naturally occurring substances such as inorganic materials e.g. clay, silica and metal oxides. The latter may be either naturally occurring or in the form of gelatinous precipitates or gels including mixtures of silica and metal oxides. Naturally occurring clays can be composed with the zeolties including those of the montmorillonite and kaolin families. The clays can be used in the raw state as originally mined or initially subjected to calcination, acid treatment or chemical modification.

The zeolite Y of the invention should have a molar $SiO_2$:$Al_2O_3$ ratio of at least 5 and more preferably at least 8 and still more preferably at least 15.

In accordance with the invention, it has been found that catalysts containing a metal hydrogenation component a modified zeolite beta and a modified Y zeolite, the Y zeolite having a unit cell size below 24.40 Å, are significantly more active and selective for the production of middle distillate than comparable Y zeolites, which for many years have and still form the component of choice in many hydrocracking catalysts. The catalyst containing the mixed zeolites simultaneously produces a distillate containing less aromatics than the beta zeolite catalyst. The compositions can also be utilised to produce distillates with superior pour point properties.

The use of beta zeolite in hydrocracking catalysts has been reported over several years although there appears to be little if any commercial exploitation.

U.S. Pat. No. 3,923,641 to Morrison discloses the hydrocracking of C5+ naphtha into $C_4$ hydrocarbons using beta zeolite.

U.S. Pat. No. 5,128,024 to La Pierre et al. discloses the use of beta zeolite containing catalysts with a $SiO_2$:$Al_2O_3$ molar ratio of up to 280:1 for simultaneous hydrocracking and dewaxing.

U.S. Pat. No. 5,284,573 to La Pierre et al. discloses the use of beta zeolite containing catalysts with $SiO_2$:$Al_2O_3$ ratios up to 500:1 for hydrotreating and dewaxing.

U.S. Pat. No. 4,612,108 to Angevine et al. discloses hydrocracking with beta zeolite directed to middle distillate production. The disclosure illustrates an improvement by using a graded bed in which the concentration of beta zeolite in the catalyst increases with bed depth.

U.S. Pat. No. 5,980,859 to Gajda et al. discloses modification of beta zeolite by steaming and extraction with ammonium nitrate by ion exchange. The modified zeolite was characterized by infrared spectroscopy. The disclosures suggest uses for catalytic cracking, hydrocracking, isomerization, transalkylation and alkylation although the use is specifically directed to benzene alkylation. No reference is made to the production of middle distillate, particularly low aromatics middle distillate by hydrocracking. The use of zeolite Y in hydrocracking catalysts has been the preferred zeolitic compound in many commercial hydrocracking catalysts.

U.S. Pat. No. 4,401,556 to Bezman discloses the use of Y zeolite containing catalyst for hydrocracking in which the Y zeolite has been modified by ion exchange and hydrothermal treatment. Middle distillate is the principal desired product. This patent, incorporated by reference, is exemplary of many patents disclosing modified Y zeolite.

U.S. Pat. No. 4,894,142 to Steigleder discloses hydrothermally modified Y zeolite for hydrocracking. The selectivity to middle distillate products is influenced by controlling the acidity of the modified zeolite.

U.S. Pat. No. 4,820,402 to Partridge et al. discloses the use of beta zeolite for hydrocracking with an $SiO_2$:$Al_2O_3$ ratio of up to 200 for producing high boiling distillate products. The data illustrate a continuous change in distillate selectivity with $SiO_2$:$Al_2O_3$ molar ratio for a range of zeolites such as Y, X, beta and ZSM-20 with $SiO_2$:$Al_2O_3$ ratios from 3 to 300.

U.S. Pat. No. 3,758,402 to Oleck et al. discloses a process for hydrocracking using a catalyst mixture comprising a large pore zeolite such an X or Y and a small pore zeolite of the ZSM-5 type.

U.S. Pat. No. 4,486,296 to Oleck discloses a hydrocracking and dewaxing catalyst and process comprising zeolite beta and Y zeolites such as rare earth exchanged X and Y, ultra stable Y, acid form of zeolite Y or other natural or synthetic faujasite zeolites. The process enables heavy feed-stocks such as gas oils boiling above 650° F. to be converted to distillate products boiling below 650° F. Use of the catalyst composition of the invention results in much higher hydrocracking activity, about the same or higher dewaxing activity, about the same distillate selectivity at high (70%) conversion compared to similar catalysts containing only beta zeolite.

U.S. Pat. No. 4,757,041 to Oleck et al. discloses a catalyst composition for hydrodewaxing and hydrocracking a hydrocarbon fraction comprising a mixture of one or more zeolites selected from the groups consisting of X and Y zeolites and other natural or synthetic zeolites and zeolite beta.

U.S. Pat. No. 5,350,501 to Ward discloses a process for hydrocracking a hydrocarbon feedstock in an atmosphere containing no more than about 200 ppmv ammonia with a catalyst comprising beta zeolite and 15-50% by weight of a Y zeolite having a unit cell size between 24.20 and 24.35 angstroms and a water vapour sorption capacity of 25° C. and $p/p_o$ value of less than about 10 wt %. The composition is useful for producing gasoline or middle distillate products, especially gasoline.

U.S. Pat. Nos. 5,447,623 and 5,536,687 to Ward, both of which are incorporated herein by reference, disclose processes, catalysts and a composition of matter comprising beta zeolite and a Y zeolite having a unit cell size of less than about 24.40 angstroms. A hydrocracking catalyst suitable for producing gasoline and turbine fuel is further described, preferably in the presence of ammonia.

U.S. Pat. No. 5,133,186 to Gosselink et al. discloses a process for performing a catalyst composition comprising a zeolite beta with a silica-alumina ratio greater than 120 and a second component selected from a crystalline molecular sieve having pores with diameter greater than 0.6 nm and/or a clay, the process comprising the steps of:

(i) Preparing a mixture comprising the first cracking component and the second cracking component, the first cracking component being in the form of a sol, (ii) Extruding the mixture into catalyst extrudates, and (iii) Calcining the extrudates.

The conversion of hydrocarbon feedstocks over the above compositions is disclosed.

U.S. Pat. No. 5,853,566 to Kraushaar-Czarnetzki discloses a catalyst comprising a beta zeolite having a silica-alumina ratio of at least 50 which is in the form of crystals with sizes in the range from 20-95 nm, a second cracking component having pores with diameters greater than 0.6 nm, (ii) crystallite mesoporous alumina silicates having pores with diameters of at least 1.3 nm and (iii) clays and at least one hydrogenation component. The catalyst is stated to be useful for converting hydrocarbonaceous feedstocks into lower boiling materials.

U.S. Pat. No. 6,399,845 to Raulo et al. discloses the production of a middle distillate, suitable as a diesel fuel, with improved low temperature properties and a low content of aromatic compounds from a hydrocarbon feed as starting material which comprises contacting said feed material in a single reaction step in the presence of hydrogen and at an elevated temperature and pressure with a bifunctional catalyst which comprises:

(a) a hydrogenating metal component which consists of one hydrogenating metal, (b) a molecular sieve, and (c) a carrier for the simultaneous removal of aromatics and isomerisation of paraffins.

The disclosure is limited to a composition comprising a molecular sieve with medium pore size, which excludes Y zeolites and is also limited to a simple hydrogenation component, which is preferred to be a noble metal.

The starting hydrocarbon is a middle distillate boiling in the range of 150° C. to 400° C. The suitable catalysts are described as any commercial catalyst for wax removal. The hydrogenation metal level specified is within the range of 0.01 to 10 wt %. A beta zeolite Si/Al ratio of 11 to 13 was shown to isomerize a tall oil fatty acid. The isomerization activity of the beta catalyst was much lower than that of a comparable SAPO 11 catalyst. No mention of dual zeolite catalysts is reported.

None of the above patents disclose the use of a catalyst comprising a mixture of beta and Y zeolites in hydrocracking for the production of low aromatics and/or low pour point middle distillates.

DISCLOSURE OF INVENTION

The present invention is specifically directed to catalysts and catalyst support comprising beta zeolites and Y zeolites, which have been modified so as to have cracking activity.

Although the modified beta and Y zeolites are the key components of this invention, the catalyst or catalyst support will generally comprise the modified zeolites intimately mixed with an acidic amorphous component and optimally a binder. The amorphous inorganic oxide can be chosen from the well known acidic oxides such as alumina, silica, titania, magnesia, zirconia, boria, phosphorous oxides along with combinations and the like. The composition of the catalyst support may contain from about 0.5 to 50 wt % modified zeolite beta preferably 1 to 30 wt % and more preferably 1 to 15 wt % modified zeolite beta. The support also comprises from about 0.5 to 50 wt % of modified Y zeolite preferably 1-30 wt % and more preferably 1 to 15 wt % of modified Y zeolite.

The $SiO_2$:$Al_2O_3$ molar ratio of the modified zeolite beta should be at least 50 and more preferably at least 100.

The modified zeolite beta, modified Y and amorphous component required in the catalyst and catalyst support of the invention are embodied into particles which contain both components. Perhaps the most convenient method for physically integrating the two components into individual particulates is to comull a wetted mixture of the components and then extrude the comulled material through a die having small openings therein of desired cross-sectional size and shape, e.g. circle, trilobal clover-leaf, quadrolobal clover leafs etc., breaking or cutting the extruded matter into appropriate lengths, drying the extrudates and then calcining at a temperature, e.g. 480° C., or higher to produce a material suitable for use in high temperature chemical conversion reactions. As stated above different cross-sectional shapes are possible such as spheres, cloverleafs of polylobal design, for example trilobal or quadrolobal shapes as shown for example in FIGS. 8 and 10, respectively, in U.S. Pat. No. 4,028,227 herein incorporated by reference in its entirety. Typically, the amorphous oxides besides contributing to the catalytic properties of the catalyst support also serve as a binder for the modified zeolite beta and modified zeolite Y. Alumina and other conventional amorphous, inorganic refractory oxide binder components may be desired.

Regardless of whether an amorphous, inorganic refractory oxide component is used as a binder material to hold the zeolite beta, zeolite Y and amorphous oxides together in the catalyst support, it will be understood that other such components can also be incorporated into the comulled mixture including for example inorganic refractory oxide diluents, which may or may not possess some type of catalyst activity.

Examples of such diluents include clays, alumina, silica-alumina and a heterogeneous dispersion of finely divided silica-alumina particles in an alumina matrix, which dispersion is described in detail in U.S. Pat. Nos. 4,097,365; 4,419,271 and 4,857,171, the disclosures of which are herein incorporated by reference in their entireties. Additionally and alternatively, hydrogenation component precursors can also be comulled into the mixture, as will be discussed in more detail hereinafter.

At this time it is preferred that the catalyst support is devoid of clays.

It is further envisioned that the modified beta and modified Y zeolite components may be incorporated in separate particles. In such a case, the catalysts may be contained in the reactor after they have been mixed.

The catalyst of the invention can be used for converting hydrocarbons and other organic compounds into more valuable reaction products by acid catalysed reactions, such as alkylation, transalkylation, dealkylation, isomerisation, dehydrocyclisation, dehydrogenation, hydrogenation, cracking, hydrocracking, dewaxing, hydrodewaxing, oligomerisation, aromatisation, alcohol conversion reactions, the conversion of syngas into mixtures of hydrocarbons and the like. When the catalyst or catalyst support contains modified zeolite beta and modified Y zeolite, but no hydrogenation components, it is useful for any of a number of acid-catalysed hydrocarbon conversion reactions in which hydrogen is not an added reactant, e.g. isomerisation, alkylation, transalkylation, cracking, dewaxing, oligomerisation etc. However, since the main benefit of the invention as presently contemplated is in hydroprocessing such as hydrocracking, a process in which hydrogen is an added reactant, the catalyst for this purpose will further require one or more hydrogenation components, in which case the portion of the catalyst exclusive of any hydrogenation metal components is considered the catalyst support upon which the hydrogenation component(s) is dispersed.

Whether the modified zeolite beta and modified Y zeolite particulates, which may optionally include an inorganic refractory oxide binder and/or diluent, are used as the catalyst itself or as the catalyst support (or support component) for hydrogenation metals, the amounts of the modified zeolite beta, the modified zeolite Y and other components present will normally depend on the particular process in which the particles are used.

When the modified zeolite beta and modified Y zeolite particulates are used for selectively producing middle distillates in a hydrocracking process, the catalyst support will typically on a dry basis contain less than 50 wt %, preferably less than 30 wt % and more preferably less than 15 wt % modified zeolite beta and modified Y zeolite with at least 50 wt %, preferably 100 wt % of the balance being an amorphous, inorganic refractory oxide binder and diluent in combination.

For use in hydroprocessing, such as hydrocracking, the catalyst contains one or more hydrogenation components containing metals selected from the group consisting of Group VIB and/or Group VIII of the periodic table of elements, such components typically being in the form of the free metals or their respective oxides and sulphides the latter two being most preferred. As used herein "Periodic Table of Elements" refers to the version found in the inside front cover of the "Handbook of Chemistry and Physics", 59$^{th}$ Edition, published in 1979 by the Chemical Rubber Company. The platinum group (or noble) metals of the Group VIII metals may be used, but preference is at present for the base (or non-noble) metals, e.g. nickel and cobalt in particular, and nickel most preferably of all. Of the group VIB metals, molybdenum and tungsten are preferred with molybdenum being most preferred when the catalyst is to be used in gasoline hydrocracking and tungsten being most preferred when the catalyst is to be used in middle distillate hydrocracking. The most highly preferred catalyst contains both a non-noble Group VIII metal component and a Group VIB metal component, most preferably nickel and molybdenum or nickel and tungsten in combination.

The hydrocracking catalysts of the invention contain at least 0.2 wt % of the hydrogenation components calculated as the metals. If noble metals are used, the hydrogenation components are generally present in a relatively low proportion, e.g. 0.2 wt % to 2 wt %. For the base or non-noble metals, the proportions are generally higher. Non-noble Group VIII metal components are typically employed in proportions between about 2 wt % and 15 wt %, preferably between 3 wt % and 10 wt %, calculated as the respective monoxide. The Group VIB metal component is generally employed in proportions of about 5 wt % to 35 wt %, preferably in the range of 8 wt % to 30 wt %, calculated as the respective trioxide. It is to be understood that the proportions given above for the hydrogenation metal components are based on the finished catalyst whereas the proportions expressed above for the modified zeolite beta and modified zeolite Y particulates are values in the absence of the hydrogenation metal component, i.e. for the catalyst support only. For purposes herein, the term "catalyst support" is defined as all materials in the catalyst except the hydrogenation metal components.

The hydrogenation components may be incorporated into the catalyst in any of many ways known in the art of combining hydrogenation components with catalyst supports containing zeolites. One such method is to first prepare the catalyst support, for example, as an extrudate containing zeolite beta, zeolite Y and an amorphous inorganic refractory oxide in calcined form and then impregnating the catalyst support with solutions containing the desired metal(s) in dissolved form. Calcination in air, typically in the absence of added steam at an elevated temperature, e.g. above 425° C., preferably above 475° C., produces the desired catalyst containing metals in oxide form. Likewise, in another embodiment, the desired metal(s) are introduced by comulling a compound containing such metal(s) in the zeolite beta and zeolite Y amorphous oxide mixture previously described followed by shaping (e.g. extrusion through a die), drying and calcining in the substantial absence of steam, e.g. at a temperature between about 425° C. and 550° C. to produce the oxide form of the catalyst. For one preferred catalyst, the comulling is effected with ammonium heptamolybdate as the source of molybdenum and nickel nitrate as the source of nickel with both compounds generally being introduced into the mulling mixture in the form of an aqueous solution. Other metals can be similarly introduced in dissolved aqueous form likewise, non-metallic elements, e.g. phosphorus.

Catalysts, which contain hydrogenation components in the oxide form as described above, are generally treated to convert the metals to the sulphide form prior to the use of the catalysts in hydrocracking. This can be accomplished by presulphiding the catalyst prior to use at an elevated temperature, e.g. 150° C. to 375° C. with for example a mixture consisting of 10 volume percent $H_2S$ and 90 volume percent $H_2$. Alternatively, the catalyst can be presulphided ex situ by various sulphiding processes; as an illustration, see "Sulphicat$^R$: Off-site Presulphiding of Hydroprocessing Catalysts from Eurocat" by J. H. Wilson and G. Berrebi, Catalysts 87, Studies in Surface Science and Catalysts #38 page 393. Alternatively, the sulphiding is accomplished in situ, i.e. by using the catalyst in the oxide form to hydrocrack a hydrocarbon feedstock containing sulphur compounds under hydrocracking conditions including elevated temperature and pressure and the presence of hydrogen.

Hydrocracking catalysts in accordance with the invention are useful in the conversion of a wide variety of hydrocarbon feedstocks to a hydrocarbon product of lower average boiling point and/or molecular weight. The feedstocks that may be subjected to hydrocracking by the methods of the invention include all mineral oils and synthetic oils (e.g. shale oil, tar sand products, etc.) and fractions thereof. Illustrative feedstocks include straight run gas oils, vacuum gas oils, coker gas oils and catcracker distillates. The typical hydrocracking feedstock, however, contains a substantial proportion of components usually at least 50 percent by volume, often at least 75% by volume boiling above the desired end point of the products, which end point, in the case of gasoline, will generally be in the range of about 190° C. to 215° C. and in the case of middle distillates will typically be in the range of 340° C. to 425° C. Usually, the feedstock will also contain gas oil components boiling above 285° C. with highly useful results being achievable with feeds containing at least 30% by volume of components boiling between 315° C. and 600° C.

For best results in hydrocracking, the catalyst of the invention will be employed as a fixed bed of catalytic particulates in a hydrocracking reactor vessel into which hydrogen and the feedstock are introduced and passed in a downwardly direction. Operating conditions in the reactor vessel are chosen so as to convert the feedstock into the desired product, which in one preferred embodiment is a hydrocarbon product containing a substantial proportion of gasoline components boiling, for example in the 85° C. to 215° C. range. However, other products such as middle distillates boiling in the 150° C. to 425° C. range may also be highly desired and conditions must be adjusted according to the product (or distribution of products) desired. The unconverted oil, e.g. hydrocarbons boiling at a temperature higher than that of the middle distillate fraction may be used for production of lube oil blending stocks, fluid cracker feedstocks or ethylene cracker feedstock. The exact conditions required in a given situation will depend on the nature of the feedstock, the particular catalyst composition utilised and the desired product(s). In general, the conditions of operation for hydrocracking will fall into the following usual and preferred ranges.

TABLE 1

| Conditions | Usual | Preferred |
|---|---|---|
| Temperature, ° C. | 230-455 | 260-430 |
| Pressure, MPa | 4-30 | 5-20 |
| LHSV, $h^{-1}$ | 0.3-5.0 | 0.5-3.5 |
| $H_2$/feedstock, $Nm^3/m^3$ | 200-2000 | 500-1500 |

The foregoing Table 1 shows the suitable and preferred hydrocracking conditions for single stage or for each stage of a two stage operation. It will be understood, however, that the operating conditions in the two stages of the two stage process are not necessarily identical. In fact, as mentioned before, the primary difference in conditions in the two hydrocracking reactor vessels of two stage operation is the presence of substantial amounts of ammonia often greater than about 2000 vol ppm in the first stage and its essential absence, i.e. less than 200 vol ppm and preferably less than about 20 vol ppm in the second allowing for less severe conditions in the second stage. There may, however, be yet other differences in conditions in any particular situation.

Based on the presently available data, the catalysts of the invention, when compared with single catalysts containing separately similar Y zeolite and similar beta zeolite, are found to be substantially more active for middle distillate production and producing low aromatic content product. The distillate products of hydrocracking with the catalyst of the invention also exhibit superior pour point characteristics. These achievements and others are illustrated in the following examples, which are provided for illustration purposes and not to limit the invention as defined by the claims.

EXAMPLES

In the examples all compositions were determined on a dry basis.

Example 1

A catalyst support was prepared by mixing together 5 wt % beta zeolite from Tosoh (molar $SiO_2$:$Al_2O_3$ ratio 1500:1) with 5% of a Tosoh Y zeolite (molar $SiO_2$:$Al_2O_3$ ratio 30:1, $A_0$=24.27 Å) and 35 wt % amorphous silica-alumina (high alumina) and 55 wt % alumina.

The resulting mixture was extruded to form 1/16" extrudates. The extrudates were dried and calcined at 550° C. for 2 hours in air. The calcined extrudates were impregnated with an aqueous solution containing nickel nitrate and ammonium metatungstate. The wet extrudates were dried and calcined at 550° C. for 2 hours in air. The final catalyst contained 6 wt % nickel oxide and 22 wt % tungsten trioxide.

Example 2

A catalyst support was prepared by mixing 5 wt % beta zeolite from Tosoh (molar $SiO_2$:$Al_2O_3$ ratio 1500:1) with 5 wt % of a Tosoh Y zeolite (molar $SiO_2$:$Al_2O_3$ ratio 30:1, $A_0$=24.29 Å) and 35 wt % silica-alumina (high alumina) and 55 wt % alumina.

The resulting mixture was extruded to form 1/16" extrudates. The extrudates were dried and calcined at 550° C. for 2 hours in air. The calcined extrudates were impregnated with an aqueous solution containing nickel nitrate and ammonium metatungstate. The wet extrudates were dried and calcined at 550° C. for 2 hours in air. The final catalyst contained 6 wt % nickel oxide and 22 wt % tungsten trioxide.

Example 3

A catalyst support was prepared by mixing 5 wt % of zeolite beta from Zeolyst (molar $SiO_2$:$Al_2O_3$ ratio 300:1), 5 wt % zeolite Y (molar $SiO_2$:$Al_2O_3$ ratio 30:1, $A_0$=24.29 Å), 35 wt % silica-alumina (high alumina) and 55 wt % alumina. The resulting mixture was extruded to form 1/16" extrudates. The extrudates were dried and calcined at 550° C. for two hours in air. The calcined extrudates were impregnated with an aqueous solution containing nickel nitrate and ammonium metatungstate. The extrudates were dried and calcined at 550° C. for two hours in air. The final catalyst contained 6 wt % nickel oxide and 22 wt % tungsten trioxide.

Example 4

A catalyst support was prepared by mixing 10 wt % of zeolite Y from Tosoh (molar $SiO_2$:$Al_2O_3$ ratio 30:1, $A_0$=24.27 Å) with 35 wt % silica-alumina (high alumina) and 55% alumina by the procedure of Example 1. The catalyst support was impregnated as in Example 1. The final catalyst contained 6 wt % nickel oxide and 22 wt % tungsten trioxide.

Example 5

A catalyst support and catalyst were prepared as in Example 1 except that 10 wt % beta zeolite obtained from Tosoh (molar $SiO_2$:$Al_2O_3$ ratio 1500:1) was used. The final catalyst contained 6 wt % nickel oxide and 22 wt % tungsten trioxide.

Example 6

A catalyst support and catalyst were prepared as in Example 1 except 10 wt % of a Y zeolite obtained from Tosoh (molar $SiO_2$:$Al_2O_3$ ratio 30:1, $A_0$=24.29 Å) was used. The final catalyst contained 6 wt % nickel oxide and 22 wt % tungsten trioxide.

Example 7

A catalyst support and catalyst were prepared as in Example 1 except 10 wt % zeolite beta obtained from Zeolyst (molar $SiO_2$:$Al_2O_3$ ratio 300:1) was used. The final catalyst contained 6 wt % nickel oxide and 22 wt % tungsten trioxide.

Example 8

The catalyst particles of Examples 4 and 5 are mixed in equal amounts so as to form a uniform mixture of the two catalyst particles.

Example 9

The catalyst particles of Examples 4 and 5 are mixed together in the ratio of 60 parts by weight of the Y zeolite-containing catalyst particles and 40 parts by weight of the beta zeolite-containing catalyst particles.

Example 10

The catalysts prepared in Examples 1-7 were tested according to the following conditions. Prior to testing, the catalyst was sulphided in the presence of hydrogen and hydrogen sulphide at a temperature from 150° C. to 360° C. Feed A (properties are given in Table 2) was passed on a once-through basis through an isothermal reactor containing catalyst particles uniformly mixed with carborundum. The catalyst was tested under the following operating conditions: LHSV of 0.5-1.0 $h^{-1}$, total pressure 14.2 MPa, and a hydrogen gas/feed ratio of 1500-1800 Nl/l. The temperature of the reactor was adjusted to provide 75 wt % conversion of the >360° C. fraction in the feedstock. The temperature required to obtain the desired conversion level was from 380-400° C. The selectivity to middle distillate products was measured as the percentage fraction of the 360° C. minus product fraction boiling in the range from 160-360° C. The conversion and selectivity were calculated from gas chromatograph boiling range analyses of the product according to ASTM D 2887.

Example 11

The catalysts of Examples 8 and 9 were evaluated under the test conditions of Example 10. The middle distillate products were found to have a low aromatics content and low pour points.

The results of the testing of all catalysts are given in Table 3. A comparison of catalysts containing modified zeolite beta and modified Y zeolite versus the calculated average for the catalysts containing only zeolite Y and beta zeolite (column 4) shows that the catalysts of the invention are very superior in terms of selectivity to middle distillates with lower aromatics content than expected. The sulphur and nitrogen content of the products are much lower than that of the feedstock. The pour point of the >360° C. product cut as compared with the pour point of the same fraction in the feedstock was reduced significantly during the processing.

TABLE 2

FEED PROPERTIES

| | FEED A | FEED B |
|---|---|---|
| Specific gravity | 0.8785 | 0.8816 |
| Sulphur, D-4294, wt % | 0.84 | 0.55 |
| Nitrogen, D-4629, wtppm | 641 | 601 |
| Hydrogen, D-4804, wt % | 12.95 | 13.05 |
| Aromatics, IP-391, wt % | | |
| Mono | 12.9 | 15.4 |
| Di | 5.1 | 4.6 |
| Tri+ | 6.6 | 6.1 |
| Pour Point, D-5949, ° C. | 30 | 30 |
| Viscosity @40° C., cSt | 13.79 | |
| Viscosity @50° C., cSt | | 11.5 |
| Viscosity @100° C., cSt | 3.229 | 3.506 |
| Distillation, ° C., D-2887 | | |
| IBP/5 | 168/264 | 209/274 |
| 10/20 | 296/326 | 308/344 |
| 30/40 | 354/371 | 366/383 |
| 50/60 | 387/402 | 399/413 |
| 70/80 | 416/432 | 425/437 |
| 90/95 | 456/477 | 451/462 |
| FBP | 514 | 489 |
| >360° C., wt % | 66.7 | 72.6 |
| >360° C. cut | | |
| Pour Point, D-5949, ° C. | 36 | |
| Specific gravity | 0.8869 | |

TABLE 3

| Example A | | | | |
|---|---|---|---|---|
| Catalyst | 4 | 1 | 5 | Calculated |
| Feed | A | A | A | A |
| Reactor Temp. (° C.) | Base | 1.4 | 3.6 | 1.8 |
| Total liquid product | | | | |
| S (wtppm) | 10 | 7 | 1 | 5.5 |
| Relative Mono aromatics (wt %) | Base | 0.76 | 3.22 | 1.61 |
| 160-220° C. product | | | | |
| Relative Mono aromatics (wt %) | Base | 0.14 | 2.00 | 1.00 |
| 220-270° C. product | | | | |
| Relative Mono aromatics (wt %) | Base | 0.26 | 3.31 | 1.65 |
| Relative pour point (° C.) | Base | −6 | −2 | −1 |
| 270-360° C. product | | | | |
| Relative Mono aromatics (wt %) | Base | 0.73 | 3.61 | 1.80 |
| Relative Pour point (° C.) | Base | −10.5 | −17 | −8.5 |
| >360° C. | | | | |
| Relative Mono aromatics (wt %) | Base | 0.75 | 2.35 | 1.18 |
| Relative pour point (° C.) | Base | −18 | −30 | −15 |
| **Example B** | | | | |
| Catalyst | 6 | 2 | 5 | Calculated |
| Feed | A | A | A | A |
| Reactor Temp. (° C.) | Base | −2.4 | 6.3 | 3.15 |
| Total liquid product | | | | |
| S (wtppm) | 4 | 4 | 1 | 2.5 |
| Relative Mono aromatics (wt %) | Base | −0.47 | 2.10 | 1.05 |
| 160-220° C. product | | | | |
| Relative Mono aromatics (wt %) | Base | −1.66 | 0.49 | 0.24 |
| 220-270° C. product | | | | |
| Relative Mono aromatics (wt %) | Base | −1.61 | 1.75 | 0.87 |
| Relative Pour point (° C.) | Base | −10 | −5 | −2.5 |
| 270-360° C. product | | | | |
| Relative Mono aromatics (wt %) | Base | 0.35 | 3.46 | 1.73 |
| Relative Pour point (° C.) | Base | −8 | −17 | −8.5 |
| >360° C. | | | | |
| Relative Mono aromatics (wt %) | Base | 0.50 | 2.32 | 1.16 |
| Relative Pour Point (° C.) | Base | −11 | −32 | −16 |
| **Example C** | | | | |
| Catalyst | 6 | 3 | 7 | Calculated |
| Feed | A | B | A | A |
| Reactor Temp. (° C.) | Base | −3.4 | −1.0 | −0.3 |
| Total liquid product | | | | |
| S (wtppm) | 4 | 3 | 3 | 3.5 |
| Relative Mono aromatics (wt %) | Base | −0.58 | 1.19 | 0.60 |
| 160-220° C. product | | | | |
| Relative Mono aromatics (wt %) | Base | −1.67 | −0.67 | 0.34 |
| 220-270° C. product | | | | |
| Relative Mono aromatics (wt %) | Base | −1.57 | 0.02 | 0.01 |
| Relative Pour point (° C.) | Base | −10 | −11 | −5.5 |
| 270-360° C. product | | | | |
| Relative Mono aromatics (wt %) | Base | 0.41 | 2.96 | 1.48 |
| Relative Pour point (° C.) | Base | −10 | −14 | −7 |
| >360° C. product | | | | |
| Relative Mono aromatics (wt %) | Base | 0.60 | 2.68 | 1.34 |
| Relative Pour point (° C.) | Base | −15 | −25 | −12 |

The arithmetic mean of the mixed zeolite catalysts are substantially more active than the components individually.

Comparison of the performance data in Table 3 shows that the aromatic content for the mixed zeolite catalyst of the invention is significantly lower than that of the catalyst composition calculated from the components (e.g. exp. 1 vs. calculated composition, exp 2 vs. calculated composition, exp 3 vs calculated composition).

The pour points of the products from the comparative evaluations are also lower for the mixed zeolite catalyst than for the individual components or their arithmetic average.

Although it should be more than clear how the invention can be utilised in the industry, it can be summarised as follows: The invention will find its use in the petroleum refining industry and more specifically in those processes employed in the petroleum refining industry that require catalysts.

Catalysts prepared in accordance with the invention are most usefully employed without hydrogenation components in such processes as catalytic cracking, catalytic isomerisation, catalytic alkylation and catalytic transalkylation. The catalysts of the invention are most usefully employed with one or more hydrogenation components when catalytic hydrocracking, catalytic hydrodenitrogenation, catalytic isomerization, lube dewaxing or catalytic hydrodesulphurisation is required. The catalyst of the invention is particularly useful for hydrocracking of gas oils and the like to produce high yields of midbarrel products boiling in the 150° C. to 420° C. range with reduced aromatics content and/or pour point, and for such hydrocracking, the most preferred catalyst comprises sulphided nickel and tungsten components on a catalyst support consisting essentially of a modified Y zeolite and a modified beta zeolite, silica-alumina, alumina and binder.

The use of the catalysts of the invention produces overall superior activity and product properties. While particular embodiments of the invention have been described, it goes without saying that the invention is not limited thereto since many obvious modifications can be made, and it is intended to include within this definition any such modifications as will fall within the scope of the appended claims.

The invention claimed is:

1. A process for hydrocracking a hydrocarbon feedstock into a low aromatic content middle distillate in the presence of hydrogen, comprising:

providing a catalyst comprising a catalyst support, the catalyst support comprising 1 to 15 wt % beta zeolite and 1 to 15 wt % Y zeolite, at elevated temperature and pressure of 260-430° C. and 5-20 MPa, the Y zeolite having a unit cell size below 24.40 Å and a molar $SiO_2$:$Al_2O_3$ ratio of at least 15, the beta zeolite having a silica-alumina ratio of at least about 250; and contacting the feedstock with the catalyst in the presence of hydrogen at elevated temperature and pressure of 260-430° C. and 5-20 MPa, to obtain a middle distillate boiling at a temperature between 150-420° C. and with a content of aromatic compounds and a pour point lower than the content of aromatic compounds, the pour point of a middle distillate being obtained by contacting the feedstock with a catalyst comprising only a Y zeolite.

2. The process of claim 1, wherein the Y zeolite has a unit cell size below 24.30 Å.

3. The process of claim 1, wherein the hydrocracking catalyst composition further comprises one or more hydrogenation components selected from nickel, cobalt, molybdenum, tungsten and chromium, their oxides and sulphides.

4. The process of claim 3, wherein the hydrogenation component is selected from nickel and tungsten, their oxides and sulphides.

5. The process of claim 1, wherein the said catalyst composition further comprises at least one amorphous component selected from the group comprising silica, alumina, titania, zirconium and their binary and tertiary compounds.

6. The process of claim 1, wherein the catalyst is in form of a physical mixture of beta zeolite and Y zeolite particles.

7. The process of claim 1, in which the hydrocarbon feedstock has been subjected to hydrotreating so as to reduce its organic nitrogen and sulphur content.

* * * * *